United States Patent [19]

Morin et al.

[11] 4,191,378

[45] Mar. 4, 1980

[54] GOLF PUTTER WITH DETACHABLE MAGNETIC TAPE PLAYER CARTRIDGE

[76] Inventors: Wilfred F. Morin, 1560 Palisade Dr.; Joseph A. Martini, 655 Plumas, Suite 171, both of Reno, Nev. 89509; Peter Marich; Harvey A. Gross, both of P.O. Box 2186, Reno, Nev. 89505

[21] Appl. No.: 902,140

[22] Filed: May 2, 1978

[51] Int. Cl.[2] ..... A63B 53/00; A63B 53/04

[52] U.S. Cl. ..... 273/162 R; 273/167 H

[58] Field of Search ..... 273/162 R, 194 R, 194 A, 273/194 B, 167 R; 46/175 AR

[56] References Cited

U.S. PATENT DOCUMENTS

| | | | |
|---|---|---|---|
| D. 226,203 | 1/1973 | Gibbs et al. | 273/162 R |
| 3,165,595 | 1/1965 | Noshiro | 46/175 AR |
| 3,550,495 | 12/1970 | Shotmeyer | 46/175 AR |

FOREIGN PATENT DOCUMENTS

| | | | |
|---|---|---|---|
| 12883 | of 1905 | United Kingdom | 273/162 R |

*Primary Examiner*—George J. Marlo

*Attorney, Agent, or Firm*—Sughrue, Rothwell, Mion, Zinn and Macpeak

[57] ABSTRACT

A golf putter having an elongated putter head of C-shaped configuration with an open side opposite the hitting face detachably carries a laterally insertable magnetic tape player cartridge which is spring latched to the head after insertion. The tape player cartridge carries a selective switch actuator within the side of the cartridge to effect limited audible tape play for several seconds.

8 Claims, 6 Drawing Figures

FIG 1
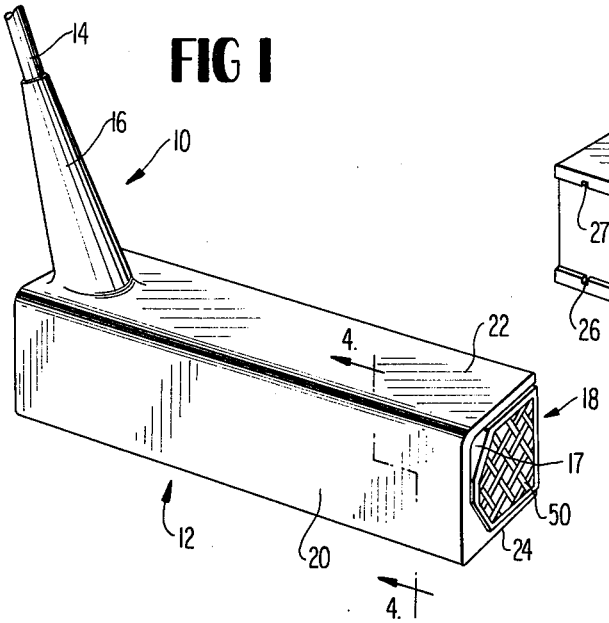
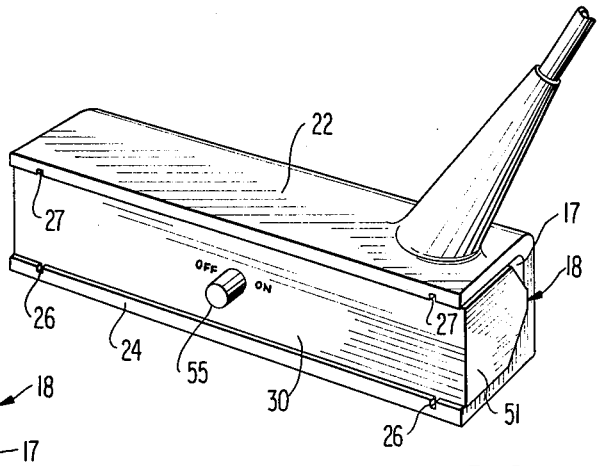
FIG 2
FIG 4
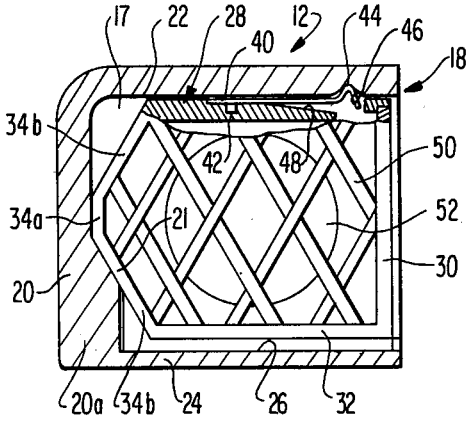
FIG 3
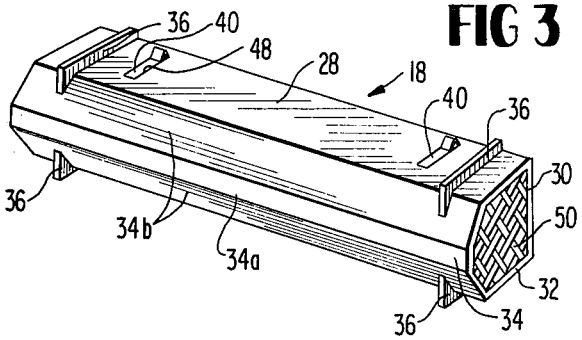
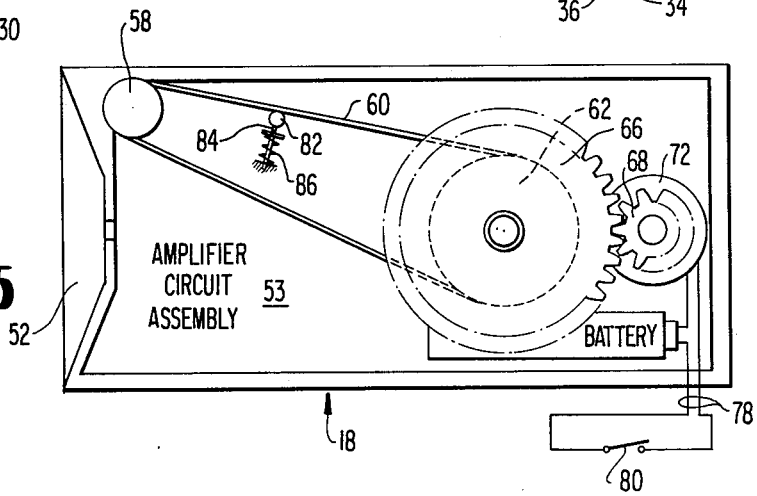
FIG 5
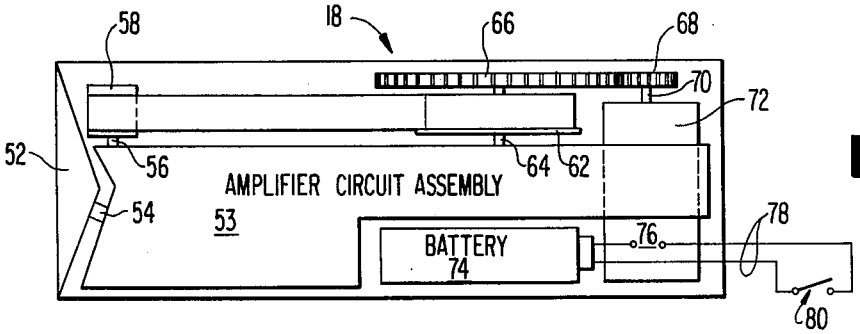
FIG 6

GOLF PUTTER WITH DETACHABLE MAGNETIC TAPE PLAYER CARTRIDGE

BACKGROUND OF THE INVENTION

1. Field of the Invention

This invention relates to golf clubs and more particularly to a putter which carries a magnetic tape player in cartridge form to provide a limited audible message to the club operator without materially affecting the putter in its normal golf ball putting function.

2. Description of the Prior Art

Golf club putters have long employed a generally rectangular, elongated solid metal or plastic head in the form of a bar with the club shaft being attached either to the side or top of the club, and being inclined with respect to the head to permit a proper movement of the head relative to the green and ball during stroke of the shaft.

SUMMARY OF THE INVENTION

The present invention is directed to the incorporation within such a putter elongated head, of a detachable magnetic tape player in cartridge form which does not materially affect the putting characteristics of the putter club and which permits the person using the putter to easily turn on the tape layer and to promote an audible message of limited duration for himself or other players within the area of the putting green.

Specifically, the putter head is of C-shaped cross section having an open side and at least one open end, and wherein the magnetic tape player cartridge constitutes an elongated, generally rectangular, casing whose configuration and outer dimensions correspond generally to the cavity dimension of the C-shaped putter head, permitting lateral insertion of the tape player cartridge casing within the head cavity. Preferably, paired elongated grooves or slots are carried within the inside faces of the head top and bottom walls defining the head cavity. The cartridge casing comprises fins projecting outwardly of the casing top and bottom of a width slightly less than that of the slots within the head such that the fins guide the casing when inserted within the head cavity. Either the upper or lower face of the cartridge casing may carry paired spring latches having a portion projecting beyond the surface of the casing and received within corresponding notches formed within the top or bottom walls of the C-shaped head on the cavity side thereof, such that upon insertion of the fins within the grooves of the head, the spring latches project within said notches to latch the removable magnetic tape player cartridge within the head. Thus, during normal putter operation, contact of the head with the ball does not tend to dislodge the detachable magnetic tape player cartridge. The cartridge casing may be longitudinally symmetrical so that it can be reversed end-for-end to permit placement in either a right-or left-hand putter.

The tape supporting and driving elements, speaker, electronic amplifier circuit componentry and battery are positioned within the cartridge casing in a manner to insure that the center of gravity of the cartridge correlates to that of the putter head so as to insure that the presence of the magnetic tape player cartridge does not adversely affect normal putter operation in putting the ball across the green. An axially projectable and twistable push button switch actuator may be projectably carried by the sidewall of the tape player cartridge casing which faces away from the cavity portion of the head on the side opposite the putter ball contact face, with the switch actuator controlling switch contacts for suitably energizing the amplifier componentry and the tape drive motor through the cartridge carried battery.

BRIEF DESCRIPTION OF THE DRAWINGS

FIG. 1 is a perspective view of a golf club putter incorporating the detachable magnetic tape player cartridge of the present invention.

FIG. 2 is a perspective view of the putter of FIG. 1 from the opposite side to that of FIG. 1.

FIG. 3 is a perspective view of the tape player cartridge detached from the putter head.

FIG. 4 is an end view, partially in section, of the putter head of FIG. 1, with the cartridge loaded therein.

FIG. 5 is a combined schematic and sectional elevational view of the cartridge of FIG. 3 showing the magnetic tape player components and switching circuit.

FIG. 6 is a combined schematic and plan view of the interior of the cartridge of FIGS. 3 and 5.

DESCRIPTION OF THE PREFERRED EMBODIMENT

Referring to the drawings, the golf club or putter 10 consists in conventional fashion of an elongated, generally rectangular, head indicated generally at 12 in the shape of a bar and joined to the inclined and upwardly projecting club shaft 14 by way of a tapered shaft and head connecting portion 16. The head 12 may be formed of molded plastic, metal or the like, including the connecting portion 16. Of particular importance to the present invention is the fact that the bar-shaped head 12 is generally of C-shaped cross-sectional configuration to define an elongated, generally rectangular, cavity 17 for the reception of a detachable—that is, separable—laterally insertable tape player cartridge indicated generally at 18, the head 12 being molded to form spaced, generally horizontal, top and bottom walls 22 and 24, respectively, the walls being integrally joined by way of a vertical front wall 20 forming the ball contact surface.

As seen in FIG. 4, the front wall is thickened somewhat at its lower end as at 20*a* to form an interior wall surface portion 21 which is inclined to the vertical. Preferably, both ends of the head are open; this permits either end of the putter to carry the cartridge speaker and its open grill, from which sound projects upon operation of the tape player components within cartridge 18. The bottom wall 24 of the putter head is provided with longitudinally-spaced, laterally-projecting grooves or slots 26, while the upper wall 22 is provided with similar shaped, positioned and configured slots or grooves 27, the grooves being provided on the cavity side of the walls and facing each other. As best seen in FIG. 3, the magnetic tape player cartridge 18 is characterized by a casing formed by horizontal, flat top and bottom walls 28 and 32, a vertical outer sidewall 30 and an inside wall 34, the inside wall 34 being formed with a vertical central portion 34*a* and, on both sides thereof, inclined sidewall portions 34*b*, such that the sidewall 34 is frusto-pyramidal in configuration. Thus, the lower inclined wall portion 34*b* abuts the tapered or inclined surface portion 21 of the inside face of the head front wall 20 which partially defines the cavity 17 within which the cartridge 18 is placed, to locate the same. Further, at longitudinally-spaced positions, there are provided vertical projecting guide fins 36 at the top and bottom of the cartridge 18, which are of a thickness and height from the cartridge top and bottom casing walls 28 and 32, so as to closely fit within the grooves 26 and 27 within the cavity side of the top and bottom walls 22 and 24 of head 12. Thus, not only is the cartridge 18 guided as it is inserted within cavity 17, but the presence of the guide fins 36 prevent any axial shifting of the cartridge 18 relative to head 10, once it is insertably mounted within cavity 17 of that member. Further, the top wall 28 of the cartridge casing is recessed as at 48, FIG. 4, and a pair of leaf spring latch members 40 are mounted within the recess by means of integral pins 42 which project from the spring-latched member at one end and are held within casing wall 28 to fix the spring-latched members to the cartridge casing. The spring-latched members 40 terminating at the other end in a V-shaped projection 44, which, when the spring-latched members 40 are in their relaxed position, and upon full insertion of the cartridge 18 within the head 12, are received within V-shaped notches 46 provided at two longitudinally-spaced positions to the side of grooves 27 and within the upper wall 22 of the head on the cavity side. Forcibly pulling of the cartridge 18 from left to right, FIG. 4, causes the V-shaped projections 44 to press towards the cartridge 18 by a camming action and permit the removal of the cartridge although, during operation of the putter, which is used in the manner of a conventional golf club putter in putting the ball on the green, the cartridge 18 will be locked both axially and laterally by the fins and the spring-latched members 40, respectively.

While the right end, FIG. 3, of the cartridge 18 is open (being covered only by the grill 50), the opposite end of the cartridge is closed off by a suitable end wall 51. The putter contains a magnetic tape indicated generally at 60, FIGS. 5 and 6, with pre-recorded statements which are activated at the will of the person operating the putter by the utilization of a twist on-off actuator or push button 55 mounted within the vertical sidewall 30 of the cartridge casing. The golfer using the club is then permitted to initiate a verbal message or group of verbal messages which are emitted through the speaker 52 while in the process of putting. However, since the club is actively used in playing the game of golf and is also highly functional in putting of the ball on the green, the location of the center of gravity of the cartridge 18 must correspond to the natural center of gravity of the head of the putter absent the cartridge. In that respect, therefore, reference to FIGS. 5 and 6 show, in partial schematic form, the componentry of the magnetic tape player within the cartridge casing. It is noted that the speaker 52, which may be seen in FIG. 4, is mounted at one end of the cartridge casing and that it is connected to the amplifier electronic circuit assembly 53 by a suitable mechanical and electrical connection as at 54, the amplifier electronic circuit assembly 53 extending longitudinally almost the full length of the unit and to the side of a battery 74 which acts to power the amplifier circuit components as well as a tape drive motor 72. The drive motor 72 is mounted at the end of the unit opposite that of the speaker 52 and is coupled by way of shaft 70 to a drive gear 68 which is in mesh with driven gear 66. The driven gear 66, by way of its shaft 64 and mounted to the side of assembly 53, bears a tape reel or drum 62 which supports one end of the endless magnetic tape 60. The opposite end is supported by and driven relative to the tape transducing head 58 which is connected to assembly 53 via shaft 56.

In order to provide proper tension, a tensioning device is preferably employed constituting an idler or roller 82, FIG. 5, which is mounted for rotation on a projectable shaft 84 which is spring biased by spring 86 towards the tape 60 to suitably tension the tape as it is driven by way of drum 62 about tape head 58. The battery 74 is connected by way of terminals 76 to the motor 72 and to the electronic amplifier circuitry of assembly 53 through electrical leads 78, all of which is under control of the switch 80. Switch 80 is schematically shown in FIGS. 5 and 6. In FIG. 2, a switch is shown as being under control of a twist on-off switch actuator 55. Alternatively, the switch may be provided within the club shaft grip or within the shaft adjacent the grip, as desired. Preferably, the switch actuator 55 is such that it must be rotated from the off position shown to the on position—that is, in a clockwise direction, FIG. 2—this permitting the tape player to be set for playing which is achieved by momentary depression of the actuator button 55. The depression of the actuator button 55 after release starts the tape for a given period of time of audible play to play one or more statements, which may be statements of instructions to the putter operator or jokes or other statements for the purpose of either calming down the putter user or to heckle an opponent, etc. The unit, therefore, constitutes a novelty item in the trade.

As may be appreciated, the cartridge may be end-to-end reversed for alternative left- and right-hand clubs, being symmetrical in form. The componentry must balance to the center of gravity of the club head. The item is preferably controlled so that it will reset itself for unlimited replays, or may be set so as to complete a single rotation of the endless tape and thus complete one tape drive cycle for each twist and depression of the actuator button 53.

While not shown, the casing may have a sidewall or endwall, such as vertical rear sidewall 30, removable from the casing to permit access to the internal tape player componentry for repair as well as replacement of the battery 74.

While the invention has been particularly shown and described with reference to a preferred embodiment thereof, it will be understood by those skilled in the art that various changes in form and details may be made therein without departing from the spirit and scope of the invention.

What is claimed is:

1. In a golf putter comprising an elongated golf head and a shaft mounted to the head and projecting upwardly therefrom, the improvement wherein said elongated golf head is C-shaped in vertical cross-section, including at least top and bottom walls joined by a sidewall and having an opposite sidewall open to define a side opening cavity, and said putter further comprises a unitary magnetic tape player cartridge, said cartridge comprising a rectangular casing which is generally configured and dimensioned to the cavity of said C-shaped elongated golf head and being insertably mounted within said cavity through said opening.

2. The putter as claimed in claim 1, wherein at least one end of said elongated head is open, and said cartridge casing is open at one end and bears a speaker facing away from the open end of said elongated putter head.

3. The putter as claimed in claim 2, wherein the cavity sides of said top and bottom walls of said C-shaped elongated head comprises longitudinally-spaced, laterally-extending grooves, and wherein said cartridge casing comprises vertical projecting fins on its top and bottom walls, and said fins being received within said grooves during sliding insertion of said rectangular cartridge casing into said head cavity.

4. The putter as claimed in claim 3, further comprising at least one spring latch including a projecting portion mounted to a horizontal face of said cartridge casing, and wherein one of the horizontal walls of said C-shaped putter head comprises a notch for receiving the projecting portion of said spring latch upon full insertion of said cartridge within said head cavity such that the engagement of said fins within said grooves prevents axial shifting of said cartridge relative to said head and at least one said spring latch prevents lateral movement of said cartridge relative to said head.

5. The putter as claimed in claim 4, wherein said magnetic tape player cartridge comprises a transducing head; a magnetic tape mounted for movement with respect to a tape transducing head; a drive motor for driving said tape; an amplifier circuit assembly for energizing said tape transducing head; a battery; means for connecting said battery to said drive motor and said amplifier assembly including a switch for controlling energization of said assembly and said motor by said battery; and a switch actuator for actuating said switch means.

6. The putter as claimed in claim 5, wherein said switch actuator comprises a rotatively twistable and axially depressible push button, and means responsive to depression of said switch actuator button when twisted to on position for selectively closing the switch contacts to connect said battery to said motor and to said amplifier circuit assembly, and means for positioning said tape, said tape drive elements including said motor, said battery, said tape transducing head, and said amplifier electronic circuit assembly within said cartridge casing so as to match the cartridge center of gravity to that of the C-shaped elongated putter head.

7. The putter as claimed in claim 1, wherein the cavity sides of said top and bottom walls of said C-shaped elongated head comprises longitudinally-spaced, laterally-extending grooves, and wherein said cartridge casing comprises vertical projecting fins on its top and bottom walls, and said fins being received within said grooves during sliding insertion of said rectangular cartridge casing into said head cavity.

8. The putter as claimed in claim 7, further comprising at least one spring latch including a projecting portion mounted to a horizontal face of said cartridge casing, and wherein one of the horizontal walls of said C-shaped putter head comprises a notch for receiving the projecting portion of said spring latch upon full insertion of said cartridge within said head cavity such that the engagement of said fins within said grooves prevents axial shifting of said cartridge relative to said head and at least one said spring latch prevents lateral movement of said cartridge relative to said head.

* * * * *